United States Patent [19]

Kinosz et al.

[11] 4,168,215

[45] Sep. 18, 1979

[54] SITU CLEANING OF ELECTROLYTIC CELLS

[75] Inventors: Donald L. Kinosz, Arnold; David A. Wohleber, Lower Burrell; Subodh K. Das, Apollo, all of Pa.

[73] Assignee: Aluminum Company of America, Pittsburgh, Pa.

[21] Appl. No.: 884,744

[22] Filed: Mar. 9, 1978

[51] Int. Cl.[2] ..... C25C 3/00; C25C 3/04; C25C 3/06; C25C 3/34

[52] U.S. Cl. ..... 204/67; 204/64 R; 204/66; 204/70

[58] Field of Search ..... 204/66, 67, 70, 64 R

[56] References Cited

U.S. PATENT DOCUMENTS

| | | | |
|---|---|---|---|
| 1,254,531 | 1/1918 | Partanen | 204/66 |
| 3,464,900 | 9/1969 | Foley et al. | 204/67 |
| 3,755,099 | 8/1973 | Haupin | 204/67 |
| 4,076,602 | 2/1978 | Wheeler | 204/70 |

*Primary Examiner*—Howard S. Williams
*Attorney, Agent, or Firm*—Andrew Alexander

[57] ABSTRACT

A method is provided for removing aluminum or compounds thereof causing a short circuit in an electrolytic cell containing aluminum chloride dissolved in a molten solvent of higher decomposition potential, the cell used for the production of aluminum from aluminum chloride and having a terminal anode and cathode providing an inter-electrode space therebetween. The method comprises removing aluminum chloride and molten solvent from the cell to an extent which exposes the materials in the inter-electrode space causing the short circuit, introducing a source of chlorinating agent to the cell and contacting the materials causing the short circuit with the chlorinating agent to form aluminum chloride, the contacting being for a time sufficient to remove the short circuit thereby permitting the addition of the aluminum chloride and solvent and the electrolysis thereof for the production of aluminum.

10 Claims, 1 Drawing Figure

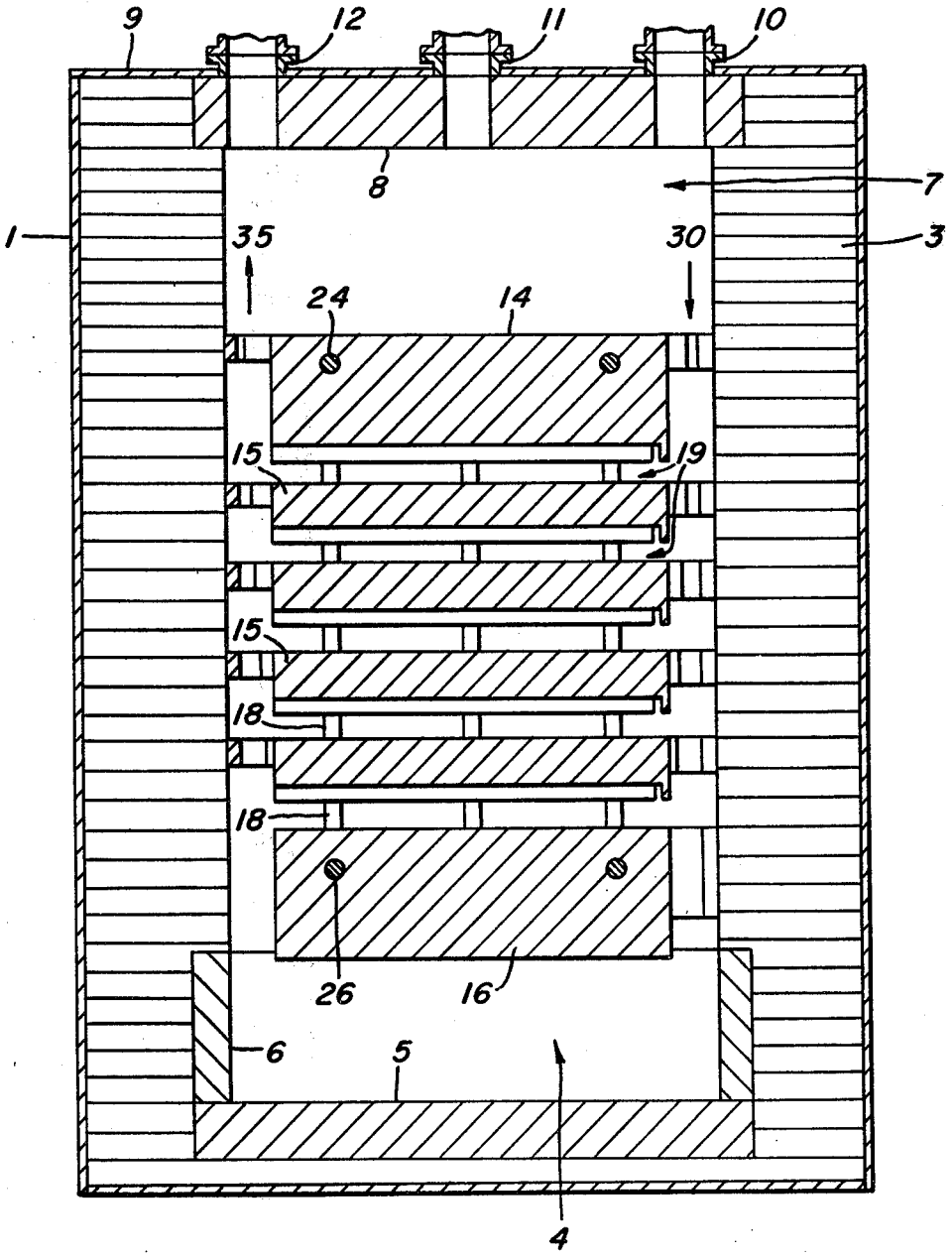
9
12
11
10
8
7
1
35
30
3
24
14
15
19
15
18
18
26
16
6
5
4

SITU CLEANING OF ELECTROLYTIC CELLS

INTRODUCTION

This invention relates to the production of metals such as aluminum, magnesium, lead and the like in an electrolytic cell. More particularly, the invention relates to a method of extending the useful life of an electrolytic cell for the production of metal from its metal halide.

One type of cell used for the production of light metal from its metal halide includes an anode, at least one intermediate bipolar electrode and a cathode in superimposed spaced relationship defining inter-electrode spaces. The spaces provide for selectively directed bath flow therethrough. Such cell structure is disclosed in U.S. Pat. No. 3,822,195, incorporated herein by reference. However, one of the problems which may be encountered in operating such a cell is maintaining a relatively fixed anode-cathode spacing during operation of the cell. The fixed spacing ensures that high current efficiency and power consumption do not change with operation of the cell. The spacing referred to is on the order of less than ¾ inch and is disclosed in U.S. Pat. No. 3,755,099, incorporated herein by reference. It should be understood that it is exceptionally difficult to maintain a set spacing with continued use of the cell. For example, as indicated in U.S. Pat. No. 3,725,222, incorporated herein by reference, when the bath contains alkali metal halide or alkaline earth metal halides as the solvent for aluminum chloride, carbonaceous cathodes of the cell are attacked by alkali metal or alkaline earth metal produced by electrolysis of such salts, causing spalling and shrinkage of the cathodes, with attendant change in the anode-cathode distance and increase in maintenance expenses. In addition, particles of carbon end up in the electrolyte and contribute to the formation of sludge at the cathode. Also, it is noted that oxygen reacts with the carbon to form gaseous oxides resulting in consumption of anode carbon which affects the operating characteristics of the cell by deleteriously changing the anode-cathode distance, as well as adding to anode expense. Another problem that can occur in the operation of an electrolytic cell, such as that noted, is a buildup of materials between the cathode and anode surfaces, for example, causing short circuit of the cell. The buildup of materials which results in a short circuit leads to shutdown of the cell. Thus, a method is desired which would aid in maintaining a desired anode-cathode distance and would permit the inexpensive removal of short circuit materials with a minimal loss of production time.

Thus, the present invention provides an inexpensive method which permits the removal of short circuit material in an electrolytic cell, the method requiring only minimal shutdown time.

SUMMARY

An object of the present invention is to provide a method for extending the useful life of an electrolytic cell.

Another object of the present invention is to provide a method for removal of materials causing a short circuit in an electrolytic cell.

Yet another object of the present invention is to provide a method for the removal of materials causing a short circuit in a bipolar electrolytic cell for the production of aluminum.

These and other objects will be apparent from the drawing, specification and claims appended hereto.

In accordance with these objects, there is provided a method for removing metal or compounds thereof causing a short circuit in an electrolytic cell containing a bath material having metal halide dissolved in a molten solvent of higher decomposition potential, the cell used for the production of metal from its metal halide and having a terminal anode and a terminal cathode providing an interelectrode space therebetween. The method further comprises removing the bath material from the cell to a point which exposes the materials causing the short circuit, introducing a halogenated material, e.g. a chlorinating agent, and contacting the materials causing the short circuit with the halogenated material, the contacting being for a period sufficient to substantially remove the materials causing the short circuit, the substantial removal of the materials again permitting the addition of the metal halide dissolved in the molten solvent of higher decomposition potential to the cell and the electrolysis thereof for the production of metal.

BRIEF DESCRIPTION OF THE FIGURE

The FIGURE is a sectional elevation illustrative of a cell for producing light metal in accordance with the invention.

DETAILED DESCRIPTION OF THE PREFERRED EMBODIMENTS

Referring to the FIGURE, the cell shown for purposes of illustrating the invention includes an outer steel shell 1, which is lined with refractory sidewall, and end wall brick 3 made of thermally insulating, electrically nonconductive material which is resistant to molten aluminum chloride-containing halide bath and the decomposition products thereof. The cell cavity accommodates a sump 4 in the lower portion for collecting the aluminum metal produced. The sump bottom 5 and walls 6 are preferably made of graphite. The cell cavity also accommodates a bath reservoir 7 in its upper zone. The cell is enclosed by a refractory roof 8 and a lid 9. A first port 10, extending through the lid 9 and roof 8, provides for insertion of a vacuum tapping tube down into sump 4, through an internal passage to be described later, for removing molten aluminum. A second port 11 provides inlet means for feeding aluminum chloride into the bath. A third port 12 provides outlet means for venting chlorine.

The cell cavity contains a plurality of plate-like electrodes which include an upper terminal anode 14, desirably an appreciable number of bipolar electrodes 15 (four being shown) and a lower terminal cathode 16. These electrodes are arranged in superimposed relation with each electrode preferably being horizontally disposed within a vertical stack. The cathode 16 is supported at each end on sump walls 6. The remaining electrodes are stacked one above the other in a spaced relationship established by interposed refractory pillars 18. Such pillars 18 are sized to closely space the electrodes, as for example to space them with their opposed surfaces separated by less than ¾ inch. In the illustrated embodiment, five interelectrode spaces 19 are formed between opposed electrodes, one between cathode 16 and the lowest of the bipolar electrodes 15, three between successive pairs of intermediate bipolar electrodes 15 and one between the highest of the bipolar electrodes 15 and anode 14. Each inter-electrode space is bounded by an upper surface of one electrode (which functions as an anode surface) opposite a lower surface of another electrode (which functions as a cathode surface), and the spacing therebetween, e.g., about ½ inch, is referred to herein as the anode-cathode distance (the electrode to electrode distance being the effective anode-cathode distance in the absence of a metal layer of substantial thickness). The bath level in the cell will vary in operation but normally will lie well above the anode 14, thus filling all otherwise unoccupied space therebelow within the cell.

Anode 14 has a plurality of electrode bars 24 inserted therein which serve as positive current leads, and cathode 16 has a plurality of collector bars 26 inserted therein which serve as negative current leads. The bars 24 and 26 extend through the cell wall and are suitably insulated from the steel shell 1.

As noted earlier, the sump 4 is adapted to contain bath and molten aluminum, and the latter may accumulate beneath the bath in the sump during operation. Should it be desired to separately heat the bath and any metal in sump 4, an auxiliary heating circuit may be established therein.

With respect to the space between the anode-cathode, it is this distance that must be carefully controlled for efficient operation of the cell, as noted hereinabove. Not only must the electrodes be arranged so as to avoid excessive spacing therebetween, but also the electrodes must be arranged so as to avoid contact with each other and the obvious short circuiting of the cell. In the present invention, it is the latter consideration which is of prime importance. That is, because of the small anode-cathode distance preferred for efficient operation of the cell, it has been discovered for some reason not clearly understood that metal or metallic materials or compounds thereof can build up or accumulate in the inter-electrode spaces resulting in a junction or bridge between the cathode and anode surfaces. This connection of the cathode and anode surfaces results in short circuiting of the cell, generation of heat and a greatly inefficient cell, which normally has to be shut down and disassembled for repair purposes.

With respect to the materials causing the short circuit, it will be noted, for example in the production of aluminum, that such materials will normally be aluminum or aluminous compouds. Aluminum carbides are illustrative of the aluminous compounds. In the instance where the cell is used for the production of lead, magnesium or zinc, for example, the materials causing the short circuit will normally be lead, magnesium or zinc, or compounds thereof. It will be appreciated that the material comprising the short circuiting junction can be a combination of the metal and compounds such as the carbides thereof.

In accordance with the principles of the present invention, it has been discovered that the materials bridging or joining the inter-electrode space can be removed with only minimal interruption in the production of the cell. That is, it has been discovered that the short circuiting materials can be removed without removing the electrodes from the cell. Thus, in accordance with the procedure of the invention, for example, if it is desired to remove short circuiting material from the inter-electrode space between anode 14 and the next bipolar electrode, bath should be removed from the cell below the inter-electrode space so as to expose the short circuiting material. A material reactive with the short circuiting material is then introduced to the cell and reacted therewith until the short circuit is substantially removed, after which the reactive material may be removed and bath added again. It should be noted that in certain cases it may be desirable to remove all of the bath and also the metal being produced, e.g., aluminum, in order to avoid formation of the metal chloride during the cleaning step.

With respect to materials reactive with the short circuiting material, halogenated compounds have been found to be quite suitable. In the instance where aluminum, magnesium, lead or zinc is being produced in the electrolytic cell, a source of chlorine is preferred. In a preferred aspect of the invention, the source of chlorine should be in gaseous form. A source of chlorine which has been found to be very suitable is selected from the group consisting of $COCl_2$, $CCl_4$, HCl, $Cl_2$, with $Cl_2$ being the preferred material in this group. When chlorine gas is used for the reactive material, the metal chloride can be removed as a gas. Thus, in an electrolytic cell, as shown in the drawing, chlorine may be introduced through port 10 and removed through port 12. Thus, for example, if aluminum is produced in the cell, gases exiting through port 12 would contain $AlCl_3$ formed from the aluminum or aluminum carbide present at the short circuiting junction. Thus, one indication of when the short circuiting material is removed would be indicated by the absence of $AlCl_3$ in the exit gas.

An important aspect of the present invention is temperature control during the period when the short circuiting material is being removed. That is, during the contacting period it is important that the temperature of the cell be maintained above the melting point of at least one of the bath and the metal being produced. If the temperature of the cell is permitted to drop until at least one of the metal and the bath solidifies, damage to lining 3 can result. For example, when the cell is used for the production of aluminum, normally the temperature should not be less than 600° C., with a preferred temperature being in the range of 660° to 900° C.

The electrolyte employed for producing metal in accordance with the subject invention normally will comprise a molten bath composed essentially of metal chloride dissolved in one or more halides of higher decomposition potential than the metal chloride. By electrolysis of such a bath, chlorine is produced on the anode surfaces and light metal on the cathode surfaces of the cell electrodes. The metal is conveniently separated by settling from the lighter bath and the chlorine rises to be vented from the cell. In such practice of the subject invention, the molten bath may be positively circulated through the cell by the buoyant gas lift effect of the internally produced chlorine gas, and light metal chloride is periodically or continuously introduced into the bath to maintain the desired concentration thereof.

The bath composition, in addition to the dissolved metal chloride, e.g., aluminum or magnesium chloride, will usually be made up of alkali metal chloride although other alkali metal halide and alkaline earth halide may also be employed. In the instance of aluminum, a presently preferred aluminum chloride containing composition comprises an alkali metal chloride base composition made up of about 50 to 75 wt.% sodium chloride and 25 to 50 wt.% lithium chloride. Aluminum chloride is dissolved in such halide composition to provide a bath from which aluminum may be produced by electrolysis, and an aluminum chloride content of about 1½ to 10 wt.% of the bath will generally be desirable. As an example, a bath analysis as follows is satisfactory: 53 wt.% NaCl, 40 wt.% LiCl, 0.5 wt.% $MgCl_2$, 0.5 wt.% KCl, 1 wt.% $CaCl_2$ and 5 wt.% $AlCl_3$. In such bath, the chlorides other than NaCl, LiCl and $AlCl_3$ may be regarded as incidental components or impurities. The bath is employed in molten condition, usually at a temperature above that of molten aluminum and in the range between 660° and 730° C., typically at about 700° C. A presently preferred magnesium chloride containing composition comprises about 80 to 98.5 wt.% lithium chloride and about 1.5 to 20 wt.% magnesium chloride.

It will be appreciated that while the electrodes have been shown stacked in a substantially horizontal arrangement, the invention will have application to electrodes provided in a vertical arrangement as shown in British Pat. No. 687,758, incorporated herein by reference. Also, it will be understood that while a bipolar cell has been shown for purposes of illustration, the present invention can have application to most types of electrolytic cells, including monopolar cells.

Thus, in the practice of the invention, materials causing a short circuit in an electrolytic cell (evidenced by a decrease in the cell resistance) may be removed by first stopping the passage of electrolyzing current and removing the bath and molten metal, if necessary, from the cell. While still maintaining a temperature above the melting point of at least one of the bath and the metal (about 700° C. in the case of an aluminum producing cell), chlorine may be introduced to or flushed through the cell for purposes of removing the short circuiting materials. The chlorine should be passed through the cell until such time as metal chloride, for example, aluminum chloride, is substantially absent in the gas leaving the cell. Thereafter, bath is reintroduced to the cell and electrolyzing current passed therethrough for the production of metal.

While the invention has been described in terms of preferred embodiments, the claims appended hereto are intended to encompass other embodiments which fall within the spirit of the invention.

What is claimed is:

1. A method of removing metal or compounds thereof causing a short circuit in an electrolytic cell containing a bath of metal chloride dissolved in a molten solvent of higher decomposition potential, the cell used for the production of metal from its metal chloride and having a terminal anode and a terminal cathode providing an inter-electrode space therebetween, the electrodes being formed from carbonaceous material, the method comprising the steps of:

(a) removing bath from the cell and exposing materials in the inter-electrode space causing the short circuit;

(b) introducing a chlorinating agent to the cell, the chlorinating agent being reactive with the materials causing the short circuit; and (c) contacting said materials with the chlorinating agent, the contacting being for a period sufficient to substantially remove said materials, the substantial removal of the materials permitting the addition of the bath to the cell and the electrolysis thereof for the production of said metal.

2. The method according to claim 1 wherein the source of the chlorinating agent is a material selected from the group consisting of $COCl_2$, $CCl_4$, HCl and $Cl_2$.

3. The method according to claim 1 wherein the source of chlorinating agent is $Cl_2$.

4. The method according to claim 1 wherein the metal is selected from the group consisting of magnesium, lead, zinc and aluminum.

5. The method according to claim 1 wherein the metal is aluminum.

6. The method according to claim 1 wherein the temperature of the cell during said contacting is maintained above the melting point of at least one of said metal and said solvent.

7. A method of removing aluminum or compounds thereof causing a short circuit in an electrolytic cell containing aluminum chloride dissolved in a molten solvent of higher decomposition potential, the cell used for the production of aluminum from aluminum chloride and having a carbonaceous terminal anode and a carbonaceous terminal cathode providing an interelectrode space therebetewwn, the method comprising the steps of:

(a) removing aluminum chloride and molten solvent from the cell and exposing materials in the interelectrode space causing the short circuit;

(b) introducing a source of chlorinating agent to the cell; and (c) contacting said materials with the chlorinating agent to form aluminum chloride therefrom, the contacting being for a period sufficient to substantially remove said materials thereby permitting addition of the aluminum chloride and the solvent to the cell and the electrolysis thereof for the production of aluminum.

8. The method according to claim 7 wherein during the contacting the cell is maintained at a temperature of at least 600° C.

9. The method according to claim 7 wherein during the contacting the cell is maintained at a temperature in the range of 660° to 900° C.

10. A method of removing aluminum or compounds thereof causing a short circuit in an electrolytic cell having a bath containing aluminum chloride dissolved in a molten solvent of higher decomposition potential, the cell used for the production of aluminum from aluminum chloride and having a terminal anode and a terminal cathode and at least one bipolar electrode arranged to operate with the anode and the cathode and providing inter-electrode spaces therebetween, the method comprising the steps of:

(a) removing aluminum chloride and molten solvent from the cell and exposing the materials in the inter-electrode spaces causing the short circuit;

(b) introducing a source of chlorinating agent to the cell;

(c) contacting said materials with the chlorinating agent to form aluminum chloride therefrom, the contacting being for a period sufficient to substantially remove the materials, the substantial removal of the materials eliminating the short circuit and permitting the addition of the aluminum chloride and the solvent to the cell and the electrolysis thereof for the production of said aluminum; and (d) during steps (a), (b) and (c), maintaining the cell at a temperature in the range of 660° to 900° C.

* * * * *

UNITED STATES PATENT AND TRADEMARK OFFICE

CERTIFICATE OF CORRECTION

PATENT NO. : 4,168,215

DATED : September 18, 1979

INVENTOR(S) : Donald L. Kinosz et al

It is certified that error appears in the above-identified patent and that said Letters Patent are hereby corrected as shown below:

Title Before "Situ" insert --In--.

Signed and Sealed this

*Fifteenth* Day of *January 1980*

[SEAL]

*Attest:*

SIDNEY A. DIAMOND

*Attesting Officer* *Commissioner of Patents and Trademarks*